United States Patent [19]

Skeist et al.

[11] Patent Number: 4,636,685

[45] **Date of Patent: * Jan. 13, 1987**

[54] MAGNETIC ARC SPREADING FLUORESCENT LAMP WITH PROTECTIVE ENVELOPE

[75] Inventors: S. Merrill Skeist, Glen Head; Leo Gross, Bayside, both of N.Y.

[73] Assignee: Spellman High Voltage Electronics Corp., Plainview, N.Y.

[ * ] Notice: The portion of the term of this patent subsequent to Jan. 19, 1999 has been disclaimed.

[21] Appl. No.: 537,588

[22] Filed: Sep. 30, 1983

[51] Int. Cl.[4] ..... H01J 1/62

[52] U.S. Cl. ..... 313/493; 313/161

[58] Field of Search ..... 313/160, 161, 493, 609, 313/611, 634

[56] References Cited

U.S. PATENT DOCUMENTS 4,311,942 1/1982 Skiest et al. ..... 313/156

4,443,734 4/1984 Gross et al. ..... 313/161

FOREIGN PATENT DOCUMENTS 235344 5/1960 Australia ..... 313/611

33386 3/1977 Japan ..... 313/161

*Primary Examiner*—Kenneth M. Schor

*Assistant Examiner*—Michael K. Boyer

*Attorney, Agent, or Firm*—Lackenbach Siegel Marzullo & Aronson

[57] ABSTRACT

An arc discharge device such as a fluorescent lamp comprising a lamp envelope having an inner phosphor coating. An arc spreading assembly is disposed in or in close proximity to the lamp envelope. The lamp envelope is of an oval or elliptical cross-section and the major axis is a multiple of the minor axis of the lamp's cross-sectional shape. The lamp envelope is strengthened mechanically and protected against atmospheric pressure by being enclosed in an evacuated outer cylindrical protective envelope.

7 Claims, 4 Drawing Figures

MAGNETIC ARC SPREADING FLUORESCENT LAMP WITH PROTECTIVE ENVELOPE

REFERENCE TO RELATED APPLICATIONS

This application is copending with application Ser. No. 235,306 now U.S. Pat. No. 4,514,662.

BACKGROUND OF THE INVENTION

1. Field of the Invention

The present invention relates to a fluorescent lamp with greater efficacy than conventional fluorescent lamps with circular cross-section. The application of magnetic fields spreads the arc throughout the larger volume of the lamp envelope.

2. Description of Prior Art

The present invention applies the technique of magnetic arc spreading coils described in the copending patent applications, Ser. Nos. 093053 and 45589 to straight line fluorescent lamps for use in fixtures, ceiling mounted or otherwise. The use of the magnetic field generated by the arc spreading coils permits lamps to be constructed with other than circular cross-section. Thus, such lamps have greater surface area with more phosphor surface activated. Lamps with arc spreading have greater efficacy than conventional fluorescent lamps with circular cross-section. However, atmospheric pressure on non-circular cross-section shaped evacuated lamp envelopes is so great that commercially feasible lamp envelopes cannot be mass produced that will not collapse inwardly except by production methods involving prohibitive cost.

SUMMARY OF THE INVENTION

The present invention applies a magnetic field to spreading the gas discharge within a fluorescent lamp with a highly flattened elliptical or oval cross-section by providing an outer protective envelope of cylindrical construction which is evacuated. Magnetic arc spreading produces a fluorescent lamp with higher luminosity and greater efficacy than a conventional fluorescent lamp with a circular cross-section.

DETAILED DESCRIPTION OF THE INVENTION

Figure 1:
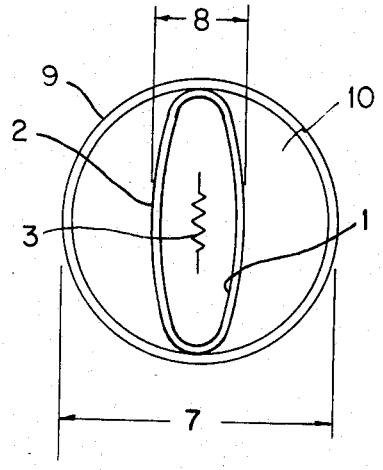
FIG. 1 is a transverse cross-sectional view of one version of a straight line fluorescent lamp of any desired length with a flattened oval cross-section for a lamp envelope with a protective enveloping of circular cylindrical cross-section.
Figure 2:
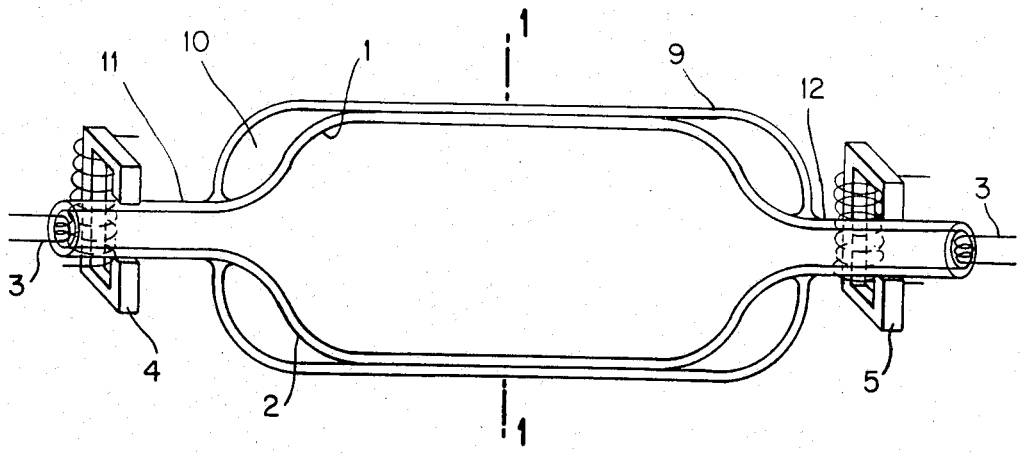
FIG. 2 is a plan view of the lamp showing location of the magnetic arc spreading coils.

A lamp envelope 2 with a high flattened elliptical or oval cross-section is shown in FIG. 1. When an arc discharge is sent through the lamp in the absence of an arc spreading coil, the discharge energizes the phosphored surface 1 only in a narrow region near the center of the lamp. However, when the arc spreading coil generates a magnetic field, the arc is spread throughout the entire volume of the lamp. The arc discharge set up within the inner lamp envelope 2 flowing between filaments 3 is spread throughout the volume of the lamp envelope 2 in the presence of a magnetic field created by the arc spreading coils 4 and 5 located near the filaments. The arc spreading coils serve as all or part of the ballast of the fluorescent lamp. The lamp envelope 2 has a cross-section, 1—1 which is elliptical or oval (FIG. 2) where the major axis diameter 7, FIG. 1 can be several time larger than minor diameter 8. The ration of the major to minor axes is a rough measure of the increase in illumination by arc spreading; a ratio of four (4) has been found to increase light output by thirty per cent(30%).

An outer envelope 9 of circular cross-sectional strengthens and protects the inner lamp envelope 2. Flattened or oval lamp envelopes lack the mechanical rigidity of circular cross-section structures. Further, atmospheric pressure can exert large forces which will cause crack propagation in regions of strain. The spaces 10 between lamp envelope 2 and outer envelope 9 are at least partially evacuated to protect the inner lamp envelope 2 from the strain of excessive pressure.

The portion of the inner lamp envelope 2 extending beyond and outwardly of the seals 12 with the outer protective envelope 9 is circular in cross-section and in all respects is similar to existing fluorescent lamp construction. These extensions, or necks 12 are approximately 5 cm long to permit placing the poles of the magnetic arc spreading coils 2–3 cm beyond the filament location, to maximize the effect of magnetic arc spreading.

Figure 3:
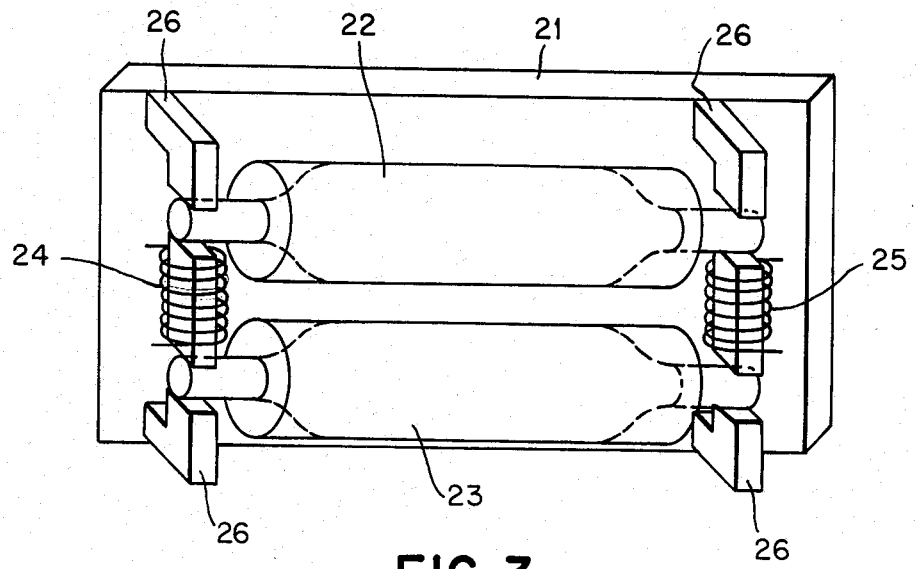
FIG. 3 is a representational view of a dual lamp structure of these protected magnetic arc spreading lamps.

In FIG. 3, two lamps with arc spreading are shown mounted in a fixture 21 in but one of a number of ways they could be arrayed. Dual envelope lamps 22, 23 are held parallel to each other with magnetic arc spreading coils 24, 25 properly phased in opposite polarities, mounted between the two lamps. The supporting structure for the lamps can contain brackets 26 to enhance and concentrate the magnetic field to maximize the effect of arc spreading by a return path of lower magnetic reluctance through the steel of the fixture.

The magnetic field of the arc spreading coil, in concert with the alternating current, diverges outwards from the pole pieces, expanding and contracting, causing the electrons generated by the arc discharge to diffuse in a direction perpendicular to both the magnetic and electric fields. The coil design will cause the arc current to spread as its component electrons spiral about the magnetic lines of force at the cyclotron frequency throughout the entire volume of the lamp. Selection of the proper number of ampere turns in the arc spreading coil spreads the arc within the confines of the lamp envelope.

Figure 4:
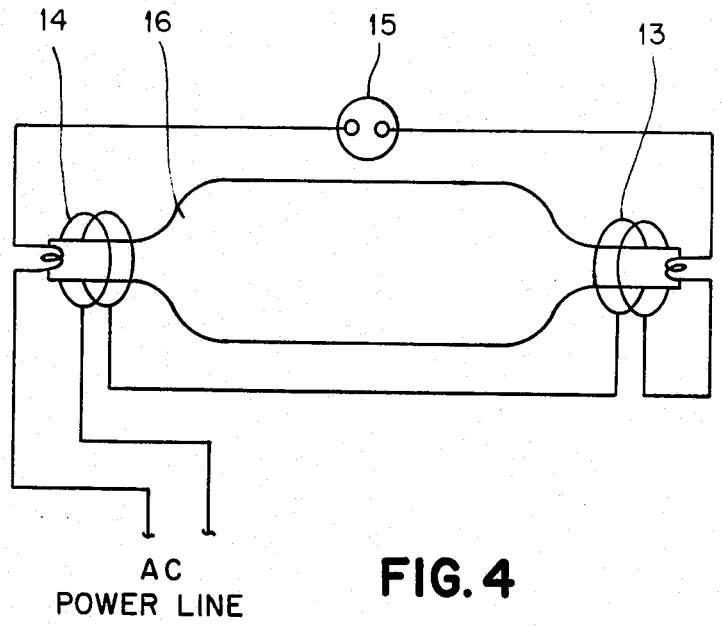
FIG. 4 is a schematic of a lamp circuit incorporating magnetic arc spreading coils.

The power through the arc is held relatively constant by the external circuitry of the lamp FIG. 4, the starter 15, the arc spreading coils/ballast 13 and 14. Little change in total lamp current is noted when the arc spreading coil is energized. In the conventional fluorescent lamp, the arc has its greatest current density at the center of an arc of approximately circular cross-section and this current density diminishes rapidy outward. The current in the center of the arc is less efficient in energizing the phosphor and producing light than the outermost current elements since radiation produced in the central regions is likely to encounter ground state mercury atoms and be absorbed before the UV light quanta reach the phosphor. This is called imprisonment of radiation or radiative absorption. Where an arc spreading coil is energized, the current density pattern is diffused as the arc spreads. The total current remains unchanged while the local current density is more uniform throughout the configuration bringing electrons closer to the lamp wall, decreasing losses due to radiative absorption. By this means, an arc spreading coil increases light output, as measured in lumens/watt, increases lamp efficacy. Arc spreading frees the lamp designer from the constraint of a long, tubular, cylindrical envelope. Conventionally long circular tubes maintain the center of the arc at the optimum distance from the phosphor, approximately 19 mm (¾") in a diameter of 38 mm (1.5"). With magnetic field arc spreading, the dimensions of the lamp envelope can be greater than the 38 mm (1.5") while maintaining effective light output from the phosphored surface. An increase in light output is achieved by encasing the arc spreading coil with a reflective material.

What is claimed is:

1. An arc discharge lamp having magnetic arc spreading means for spreading the arc discharge of said lamp, comprising an inner lamp envelope of flattened oval or elliptical cross-section, an outer clear, transparent protective envelope of circular cross-section, surrounding and enclosing said inner lamp envelope; the space defined between said inner lamp envelope and said protective envelope being at least partially evacuated; and said inner lamp envelope containing two electrodes for forming an arc and being coated with a luminescent fluorescent phosphor on the interior wall thereof; whereby the low gas pressure in said space between said envelopes prevents atmospheric pressure from weakening said inner lamp envelope or causing crack propagation in regions of strain.

2. An arc discharge lamp according to claim 1, wherein said arc spreading means is outward of said protective envelope.

3. An arc discharge lamp according to claim 1, wherein said inner lamp envelope is highly flattened in cross-section.

4. An arc discharge lamp according to claim 1, wherein said inner lamp envelope has a major axis substantially at least four times larger than the dimension of the minor axis of said inner lamp envelope.

5. An arc discharge lamp according to claim 2, further comprising a pair of fluorescent lamps with the lamps being mounted in a substantially parallel relationship and wherein the magentic arc spreading means are mounted between said pair of lamps with magnetic pole means in close proximity to said protective envelopes, said magnetic arc spreading means including coils of opposite polarities so that one pole of said magnetic arc spreading means affects one of said lamps and the other pole spreads the arc of the other lamp.

6. An arc discharge lamp, according to claim 5, including a supporting structure for said pair of lamps are intergal with the magnetic arc spreading means.

7. An arc discharge lamp acording to claim 6, wherein said supporting structure is a matallic fixture comprising a base with brackets for concentrating the magnetic field so as to increase effect an arc spreading by a return path through the metallic fixture.

* * * * *